US010510295B2

(12) United States Patent
Zhang et al.

(10) Patent No.: US 10,510,295 B2
(45) Date of Patent: Dec. 17, 2019

(54) APPARATUS AND METHOD FOR CONTROLLING EL DRIVE VOLTAGE OF DISPLAY PANEL

(71) Applicants: BOE TECHNOLOGY GROUP CO., LTD., Beijing (CN); ORDOS YUANSHENG OPTOELECTRONICS CO., LTD., Ordos (CN)

(72) Inventors: Chenggeng Zhang, Beijing (CN); Nan Lu, Beijing (CN); Yufei Wang, Beijing (CN); Hualing Yang, Beijing (CN); Jing Liu, Beijing (CN)

(73) Assignees: BOE Technology Group Co., Ltd., Beijing (CN); Ordos Yuansheng Optoelectronics Co., Ltd., Ordos (CN)

( * ) Notice: Subject to any disclaimer, the term of this patent is extended or adjusted under 35 U.S.C. 154(b) by 0 days.

(21) Appl. No.: 15/739,951

(22) PCT Filed: Jun. 9, 2017

(86) PCT No.: PCT/CN2017/087745
§ 371 (c)(1),
(2) Date: Dec. 26, 2017

(87) PCT Pub. No.: WO2018/072456
PCT Pub. Date: Apr. 26, 2018

(65) Prior Publication Data

US 2018/0315375 A1 Nov. 1, 2018

(30) Foreign Application Priority Data

Oct. 21, 2016 (CN) ..... 2016 1 0920702

(51) Int. Cl.
*G09G 3/3258* (2016.01)
*G09G 3/3233* (2016.01)
*G09G 3/3225* (2016.01)

(52) U.S. Cl.
CPC ..... *G09G 3/3258* (2013.01); *G09G 3/3225* (2013.01); *G09G 3/3233* (2013.01);
(Continued)

(58) Field of Classification Search
None
See application file for complete search history.

(56) References Cited

U.S. PATENT DOCUMENTS 7,321,199 B2 * 1/2008 Lee ..... H02M 3/1584 315/194
7,372,679 B1 5/2008 Ho et al.
(Continued)

FOREIGN PATENT DOCUMENTS

CN 101426323 A 5/2009
CN 104036727 A 9/2014
(Continued)

OTHER PUBLICATIONS

Office Action from Chinese Application No. 201610920702.0 dated Jul. 4, 2017 (7 pages).
(Continued)

*Primary Examiner* — Chad M Dicke
(74) *Attorney, Agent, or Firm* — Harness, Dickey & Pierce, P.L.C.

(57) ABSTRACT

An apparatus for controlling an EL drive voltage for a display panel is disclosed, which includes a current sensing circuit configured to detect an EL drive current signal outputted to the display panel, and convert the EL drive current signal into a first voltage signal, a signal generation circuit configured to generate a pulse signal based on the first
(Continued)

voltage signal, a current protection circuit configured to generate a first control signal based on the first voltage signal and a reference voltage, and a signal coupling circuit configured to output, based on the first control signal, the pulse signal or a low level signal as a second control signal to control the EL drive voltage. According to the embodiments of the present disclosure, the EL drive voltage of the display panel can be dynamically controlled, and be reset to normal when it is overhigh.

20 Claims, 3 Drawing Sheets

(52) U.S. Cl.
CPC ..... *G09G 2310/0291* (2013.01); *G09G 2320/0295* (2013.01); *G09G 2330/021* (2013.01); *G09G 2330/028* (2013.01); *G09G 2330/045* (2013.01)

(56) References Cited

U.S. PATENT DOCUMENTS 7,777,166 B2 * 8/2010 Roberts ..... F21K 9/00 250/205
8,581,808 B2 * 11/2013 Kim ..... G09G 3/3216 345/77
9,799,263 B2 * 10/2017 Zhang ..... G09G 3/3208
2007/0080905 A1 * 4/2007 Takahara ..... G09G 3/3233 345/76
2007/0222718 A1 * 9/2007 Takahara ..... G09G 3/2011 345/76
2008/0042628 A1 * 2/2008 Wang ..... H02M 1/08 323/271
2008/0174287 A1 * 7/2008 Park ..... H02M 3/158 323/271
2009/0109142 A1 * 4/2009 Takahara ..... G09G 3/006 345/76
2009/0109168 A1 4/2009 Lee et al.
2010/0073357 A1 3/2010 Min et al.
2010/0220039 A1 * 9/2010 Park ..... H02M 3/1588 345/76
2010/0277104 A1 * 11/2010 Lin ..... H03K 7/08 315/312
2011/0115835 A1 * 5/2011 Lee ..... G09G 3/3233 345/691
2011/0273109 A1 * 11/2011 Park ..... G09G 3/3225 315/291
2012/0327066 A1 * 12/2012 Kato ..... G09G 3/3225 345/212
2014/0118414 A1 * 5/2014 Seo ..... G09G 3/3208 345/690
2015/0317028 A1 * 11/2015 Takahashi ..... G09G 3/3233 345/173
2016/0379554 A1 12/2016 Zhang et al.
2017/0278454 A1 9/2017 Zhang et al.
2018/0190746 A1 * 7/2018 Yamamoto ..... G09G 3/3233

FOREIGN PATENT DOCUMENTS

CN 104715721 A 6/2015
CN 104900190 A 9/2015
CN 104933987 A 9/2015
CN 105469742 A 4/2016
CN 105976756 A 9/2016
CN 106448561 A 2/2017

OTHER PUBLICATIONS

International Search Report from PCT Application No. PCT/CN2017/087745 dated Sep. 6, 2017 (5 pages).
Written Opinion from PCT Application No. PCT/CN2017/087745 dated Sep. 6, 2017 (6 pages).

* cited by examiner

APPARATUS AND METHOD FOR CONTROLLING EL DRIVE VOLTAGE OF DISPLAY PANEL

CROSS-REFERENCE TO RELATED APPLICATION

This application claims the benefit and priority of Chinese Patent Application No. 201610920702.0 filed on Oct. 21, 2016, the entire content of which is incorporated herein by reference as a part of the present application.

BACKGROUND

The present disclosure relates to the field of display technologies, and more particularly to an apparatus and a method, as well as a display apparatus for controlling an EL drive voltage for an active matrix organic light emitting diode (AMOLED) display panel.

In a display apparatus including an AMOLED display panel, a display driver IC controls display modes and display contents of the AMOLED display panel, and a power driver IC provides the AMOLED display panel with an EL drive signal ELVDD/ELVSS and other special voltages required for the display panel. Because of self-luminous and current-drive characteristics of the AMOLED display panel, the AMOLED display panel is insensitive to a high voltage in the case of a constant current. In practical use, an extra high voltage does not increase a luminous intensity of an OLED, but causes increase of power consumption of the display panel and thus causing the display panel to generate heat, thereby making the user experience bad.

The display driver IC dynamically controls the voltage of the EL drive signal ELVDD/ELVSS according to a display frame or a temperature of the display panel. However, the display driver IC cannot accurately determine whether the voltage is too high or too low. The EL drive voltage (i.e., the voltage of the EL drive signal ELVDD/ELVSS) affects the voltage applied to an OLED means and a drive transistor. When the EL drive voltage is normal, the OLED apparatus emits light normally and the voltage applied to the drive transistor is normal. However, once the EL drive voltage exceeds a threshold, the voltage applied to the drive transistor may become overhigh, which may increase the power consumption of the display panel, and thus causing the display panel to generate heat due to long-time running or even destroying the display panel.

BRIEF DESCRIPTION

Embodiments described in the present disclosure provide an apparatus and a method for controlling an EL drive voltage for a display panel and a display apparatus, which can detect a current of an EL drive signal ELVDD/ELVSS outputted to the display panel, and implement a dynamic voltage control of the EL drive signal ELVDD/ELVSS through the detected current. A dynamic control of the power consumption of the display panel may be implemented by dynamically controlling the EL drive voltage. When the power consumption of the display panel exceeds predetermined power consumption, the power driver IC can be automatically restarted to reset the voltage of the EL drive signal ELVDD/ELVSS, thereby ensuring the power consumption of the display panel returns to normal.

A first aspect of the present disclosure provides an apparatus for controlling an EL drive voltage for a display panel. The apparatus includes a current sensing circuit configured to detect an EL drive current signal outputted to the display panel, and convert the EL drive current signal into a first voltage signal, a signal generation circuit configured to generate a pulse signal based on the first voltage signal from the current sensing circuit, a current protection circuit configured to generate a first control signal based on the first voltage signal from the current sensing circuit and a reference voltage, and a signal coupling circuit configured to output, based on the first control signal, the pulse signal or a low level signal as a second control signal to control the EL drive voltage.

In an embodiment of the present disclosure, an amplitude of the first voltage signal is positively correlated with that of the EL drive current signal.

In an embodiment of the present disclosure, the signal generation circuit is further configured to set a parameter of the pulse signal based on the amplitude of the first voltage signal.

In an embodiment of the present disclosure, the parameter of the pulse signal includes one or more of a frequency, a period, an amplitude, and a duty cycle.

In an embodiment of the present disclosure, the signal generation circuit includes a signal generator based on 1-wire protocol.

In an embodiment of the present disclosure, the first control signal is linearly correlated with the first voltage signal.

In an embodiment of the present disclosure, the current protection circuit includes a first resistor, a second resistor, a third resistor, a first capacitor, and an operational amplifier. A first end of the first resistor is coupled to one of an output terminal of the current sensing circuit and a reference voltage terminal. A second end of the first resistor is coupled to a first end of the second resistor, a first end of the first capacitor, and an inverting input terminal of the operational amplifier. A second end of the second resistor is coupled to a second end of the first capacitor and an output terminal of the operational amplifier, and the output terminal of the operational amplifier is an output terminal of the current protection circuit. A first end of the third resistor is coupled to another one of the output terminal of the current sensing circuit and the reference voltage terminal, and a second end of the third resistor is coupled to a non-inverting input terminal of the operational amplifier.

In an embodiment of the present disclosure, the signal coupling circuit is configured to output the pulse signal in response to the amplitude of the first control signal being less than a threshold, and output the low level signal in response to the amplitude of the first control signal being greater than or equal to the threshold.

In an embodiment of the present disclosure, the signal coupling circuit includes a transistor. A control electrode of the transistor is coupled to the output terminal of the current protection circuit, a first electrode of the transistor is coupled to a low level signal terminal, and a second electrode of the transistor is coupled to an output terminal of the signal generation circuit and is used as an output terminal of the signal coupling circuit.

In an embodiment of the present disclosure, the transistor is an N-type transistor or a P-type transistor.

A second aspect of the present disclosure provides a display apparatus, which includes a display panel, and the aforementioned apparatus for controlling an EL drive voltage outputted to the display panel.

In an embodiment of the present disclosure, the display panel is an AMOLED display panel.

A third aspect of the present disclosure provides a method for controlling an EL drive voltage for a display panel. The method includes detecting an EL drive current signal outputted to the display panel, converting the EL drive current signal into a first voltage signal, generating a pulse signal based on the first voltage signal, generating a first control signal based on the first voltage signal and a reference voltage; and outputting, based on the first control signal, the pulse signal or a low level signal as a second control signal to control the EL drive voltage.

In an embodiment of the present disclosure, an amplitude of the first voltage signal is positively correlated with that of the EL drive current signal.

In an embodiment of the present disclosure, in the generating of the pulse signal based on the first voltage signal, a parameter of the pulse signal is set based on the amplitude of the first voltage signal.

In an embodiment of the present disclosure, the parameter of the pulse signal includes one or more of a frequency, a period, an amplitude, and a duty cycle.

In an embodiment of the present disclosure, the first control signal is linearly correlated with the first voltage signal.

In an embodiment of the present disclosure, outputting, based on the first control signal, the pulse signal or a low level signal as a second control signal comprises outputting the pulse signal as the second control signal in response to the amplitude of the first control signal being less than a threshold, and outputting the low level signal as the second control signal in response to the amplitude of the first control signal being greater than or equal to the threshold.

In an embodiment of the present disclosure, the EL drive voltage is adjusted according to the parameter of the pulse signal in response to outputting the pulse signal as the second control signal. The EL drive voltage is reset in response to outputting the low level signal as the second control signal.

The apparatus for controlling an EL drive voltage for a display panel according to an embodiment of the present disclosure can dynamically control the control signal provided to the power driver IC, so as to cause the power driver IC to dynamically control the amplitude of the EL drive voltage, thereby implementing a dynamic control of the power consumption of the display panel.

DETAILED DESCRIPTION

To make objectives, technical solutions, and advantages of the embodiments of the present disclosure clearer, the technical solutions in the embodiments of the present disclosure will be described clearly and completely below, in conjunction with the accompanying drawings in the embodiments of the present disclosure. Obviously, the described embodiments are merely some but not all of the embodiments of the present disclosure. All other embodiments obtained by those skilled in the art based on the described embodiments of the present disclosure without creative efforts shall fall within the protecting scope of the present disclosure.

Unless otherwise defined, all terms (including technical and scientific terms) used herein have the same meaning as commonly understood by those skilled in the art to which present disclosure belongs. It will be further understood that terms, such as those defined in commonly used dictionaries, should be interpreted as having a meaning that is consistent with their meaning in the context of the specification and will not be interpreted in an idealized or overly formal sense unless expressly so defined herein. As used herein, the description of "connecting" or "coupling" two or more parts together should refer to the parts being directly combined together or being combined via one or more intermediate components.

In all the embodiments of the present disclosure, a source and a drain (an emitter and a collector) of a transistor are symmetrical, and a current from the source to the drain (from the emitter to the collector) to turn on an N-type transistor is in an opposite direction with respect to the current from the source to the drain (from the emitter and the collector) to turn on an a P-type transistor. Therefore, in the embodiments of the present disclosure, a controlled intermediate terminal of the transistor is referred to as a control electrode, a signal input terminal is referred to as a first electrode, and a signal output terminal is referred to as a second electrode.

Figure 1:
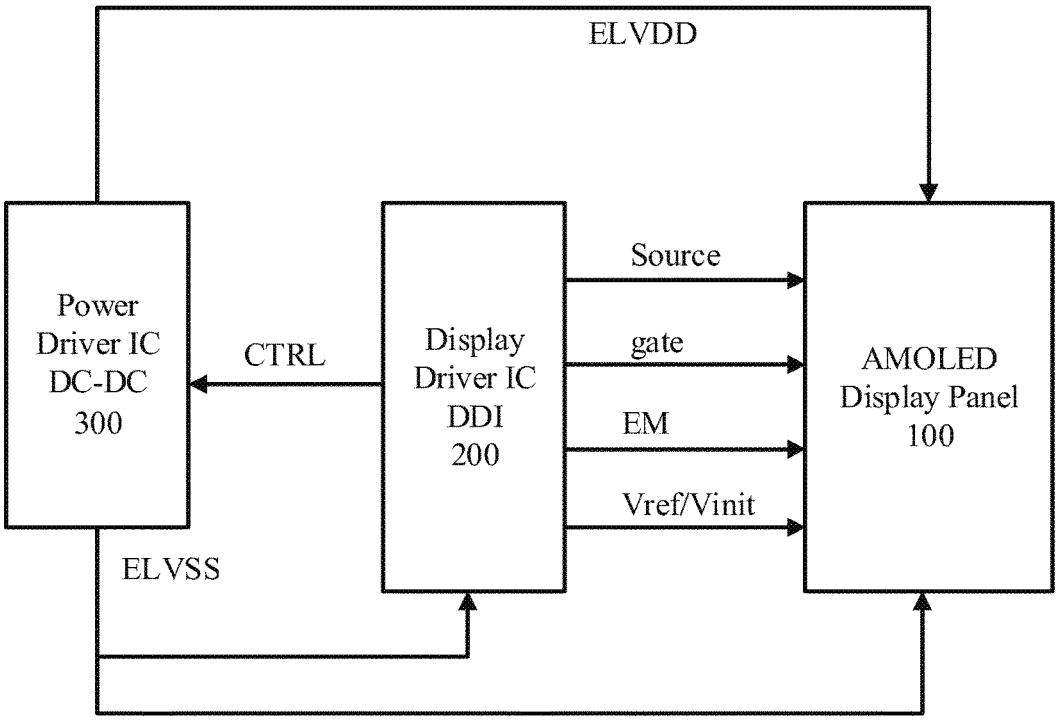
FIG. 1 is a schematic diagram illustrating a connection relation among an AMOLED display panel, a display driver IC, and a power driver IC.

FIG. 1 is a schematic diagram illustrating a connection relation among an AMOLED display panel 100, a display driver IC 200, and a power driver IC 300. As shown in FIG. 1, the display driver IC 200 provides the AMOLED display panel 100 with various signals for controlling a light-emitting element in the AMOLED display panel 100 to emit light, for example, Source, gate, EM, and Vref/Vinit, etc. The power driver IC 300 provides the AMOLED display panel 100 with EL drive signals ELVDD and ELVSS. The display driver IC 200 includes an apparatus for dynamically controlling an EL drive voltage (not shown), which provides the power driver IC 300 with a second control signal CTRL for dynamically controlling the EL drive voltage. When the EL drive voltage is overhigh, the second control signal CTRL is employed to restart the power driver IC 300, and reset the EL drive voltage.

Figure 2:
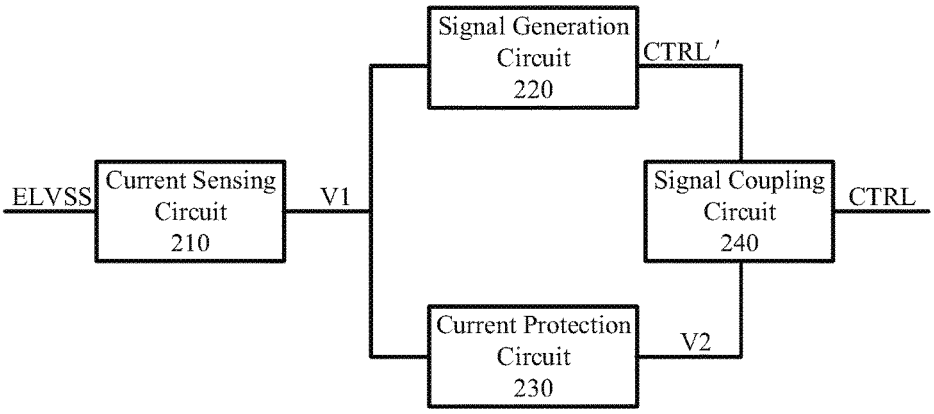
FIG. 2 is a schematic block diagram of an example apparatus for controlling an EL drive voltage for a display panel according to an embodiment of the present disclosure.

FIG. 2 is a schematic block diagram of an example apparatus for controlling an EL drive voltage for a display panel according to an embodiment of the present disclosure. The example apparatus includes a current sensing circuit 210, a signal generation circuit 220, a current protection circuit 230, and a signal coupling circuit 240.

The current sensing circuit 210 is connected to the signal generation circuit 220 and the current protection circuit 230, detects, in real time, a current signal such as the EL drive signal ELVSS (or ELVDD) outputted to the AMOLED display panel 100, converts the current signal into a first voltage signal U1, and outputs the first voltage signal U1 from the current sensing circuit 210 to the signal generation circuit 220 and the current protection circuit 230. In this embodiment, an amplitude of the first voltage signal U1 is positively correlated with that of the EL drive current signal.

The signal generation circuit 220 is connected to the current sensing circuit 210 and the signal coupling circuit 240, generates a pulse signal CTRL' based on the first voltage signal U1 from the current sensing circuit 210, and outputs the pulse signal CTRL' to the signal coupling circuit 240. The signal generation circuit 220 is further configured to dynamically set, in real time, a parameter, such as a frequency, a period, an amplitude, and a duty cycle, of the pulse signal CTRL' based on the amplitude of the first voltage signal U1 from the current sensing circuit 210.

The current protection circuit 230 is connected to the current sensing circuit 210 and the signal coupling circuit 240, and generates a first control signal U2 based on the first voltage signal U1 from the current sensing circuit 210 and a reference voltage VREF. Then, the first control signal U2 is outputted to the signal coupling circuit 240. In this embodiment, the first control signal U2 is linearly correlated with the first voltage signal U1.

The signal coupling circuit 240 is connected to the signal generation circuit 220 and the current protection circuit 230, and outputs, based on the first control signal U2, the pulse signal CTRL' generated by the signal generation circuit 220 or a low level signal as a second control signal CTRL to control the voltage of the EL drive signal ELVSS. When the amplitude of the first control signal U2 is smaller than a threshold for opening the signal coupling circuit, the signal coupling circuit 240 outputs the pulse signal CTRL' to the power driver IC 300. In this case, the power driver IC 300 as shown in FIG. 1 can dynamically adjust the voltage of the EL drive signal ELVDD/ELVSS outputted by the power driver IC 300, according to the parameter(s), such as the frequency, the period, the amplitude, and the duty cycle, of the pulse signal CTRL'. For example, the EL drive voltage is properly reduced if the frequency of the pulse signal CTRL' is higher than a preset value. The EL drive voltage is properly increased if the frequency of the pulse signal CTRL' is lower than the preset value. When the amplitude of the first control signal U2 is greater than or equal to the threshold for opening the signal coupling circuit, the signal coupling circuit 240 is opened and outputs the low level signal to the power driver IC 300. In such a case, the power driver IC 300 will be automatically restarted, so that the voltage of the EL drive signal ELVDD/ELVSS outputted by the power driver IC 300 is reset.

Figure 3:
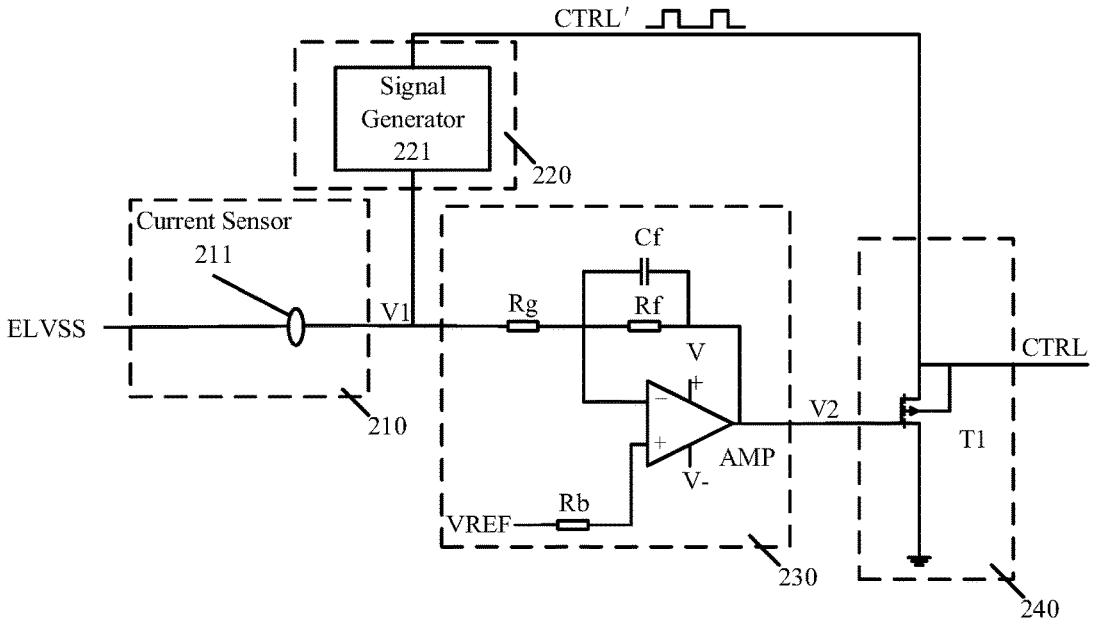
FIG. 3 is a schematic structural diagram of an example apparatus for controlling an EL drive voltage for a display panel according to an embodiment of the present disclosure.

FIG. 3 is a schematic structural diagram of an example apparatus for controlling an EL drive voltage for a display panel according to an embodiment of the present disclosure. As shown in FIG. 3, the current sensing circuit 210 may include a current sensor 211, which is configured to detect an EL drive current signal outputted to the AMOLED display panel 100. The EL drive current signal then is converted into the first voltage signal U1 by, for example, a converter (not shown). In this embodiment, the amplitude of the first voltage signal U1 outputted from the current sensing circuit 210 is positively correlated with that of the EL drive current signal. That is, the amplitude of the first voltage signal U1 is also increased when the amplitude of the EL drive current is increased. A symbol of the first voltage signal U1 may be the same as or opposite to that of the EL drive current signal.

The signal generation circuit 220 includes a signal generator 221 based on 1-wire protocol. The signal generator 221 can generate the pulse signal CTRL' according to the first voltage signal U1 from the current sensing circuit 210, and dynamically set the parameter, such as the frequency, the period, the amplitude, and the duty cycle, of the pulse signal CTRL' based on the amplitude of the first voltage signal U1.

The current protection circuit 230 includes a first resistor Rg, a second resistor Rf, a third resistor Rb, a first capacitor Cf, and an operational amplifier AMP. The current protection circuit 230 is configured to generate the first control signal U2 based on the first voltage signal U1 from the current sensing circuit 210 and the reference voltage VREF. The first control signal U1 is linearly correlated with the first voltage signal U2.

The signal coupling circuit 240 includes a transistor T1. A control electrode of the transistor T1 is coupled to the output terminal of the current protection circuit 230, a first electrode of the transistor T1 is coupled to a low level signal terminal, and a second electrode of the transistor T1 is coupled to an output terminal of the signal generation circuit 220 and is used as an output terminal of the signal coupling circuit 240.

In an embodiment of the present disclosure, a type of the transistor T1 in the signal coupling circuit 240 and the way of connecting the first voltage signal U1 and the reference voltage VREF to the current protection circuit 230 may be selected based on a positive or negative polarity of the detected EL drive signal.

For example, in a first example, when the detected EL drive signal is a positive voltage signal, the reference voltage VREF is set as a positive voltage, and the transistor T1 is a P-type transistor. In the current protection circuit 230, a first end of the first resistor Rg is coupled to an output terminal (i.e., the first voltage signal U1) of the current sensing circuit 210, and a second end of the first resistor Rg is coupled to a first end of the second resistor Rf, a first end of the first capacitor Cf, and an inverting input terminal of the operational amplifier AMP. A second end of the second resistor Rf is coupled to a second end of the first capacitor Cf and an output terminal of the operational amplifier AMP, and the output terminal of the operational amplifier AMP is an output terminal of the current protection circuit. A first end of the third resistor Rb is coupled to the reference voltage VREF, and a second end of the third resistor Rb is coupled to a non-inverting input terminal of the operational amplifier AMP.

According to the above arrangement, the voltage V2 of the first control signal U2 is calculated by the following Equation (1):

$$V2 = \frac{(Rg + Rf) \times VREF - Rf \times V1}{Rg} \tag{1}$$

In the above Equation (1), Rg is a resistance value of the first resistor Rg, Rf is a resistance value of the second resistor Rf, VREF is a voltage value of the reference voltage VREF, and the V1 is the voltage value of the first voltage signal U1. The first control signal U2 is negatively correlated with the first voltage signal U1. Since the reference voltage VREF is a constant value, in the case that the following formula (2) is satisfied, the voltage V2 of the first control signal U2 is a positive voltage, the transistor T1 is turned off, and the signal coupling circuit 240 outputs to the power driver IC 300 the pulse signal CTRL' from the signal generation circuit 220.

$$V1 < \frac{(Rg + Rf) \times VREF}{Rf} \tag{2}$$

With the increasing of the voltage V1 of the first voltage signal U1, when the formula (2) is not satisfied, the voltage V2 of the first control signal U2 becomes a negative voltage, and the amplitude |V2| of the voltage V2 of the first control signal U2 is positively correlated with the amplitude |V1| of the voltage V1 of the first voltage signal U1. When the amplitude |V2| of the voltage V2 of the first control signal U2 is lower than the amplitude |Vth| (i.e., |V2|<|Vth|) of the threshold voltage Vth of the transistor T1, the transistor T1 remains off, and the signal coupling circuit 240 continues outputting to the power driver IC 300 the pulse signal CTRL' from the signal generation circuit 220. The power driver IC 300 can dynamically adjust the voltage of the EL drive signal ELVDD/ELVSS outputted by the power driver IC 300, according to the parameter, such as the frequency, the period, the amplitude, and the duty cycle, of the pulse signal CTRL'. For example, the EL drive voltage is properly reduced if the frequency of the pulse signal CTRL' is higher than a preset value. The EL drive voltage is properly increased if the frequency of the pulse signal CTRL' is lower than the preset value.

With further increasing of the voltage V1 of the first voltage signal U1, when the voltage V1 of the first voltage signal U1 is overhigh so that the amplitude |V2| of the voltage V2 of the first control signal U2 is greater than or equal to the amplitude |Vth| of the threshold voltage Vth of the transistor T1 (i.e., |V2|≥|Vth|), the transistor T1 is turned on, and the voltage of the second electrode of the transistor T1 is equal to that of the first electrode of the transistor T1 (i.e., a low level). In such a case, the signal coupling circuit 240 outputs a low level signal to the power driver IC 300, and the power driver IC 300 is automatically restarted, so that the voltage of the EL drive signal ELVDD/ELVSS outputted by the power driver IC 300 is reset.

In a second example, when the detected EL drive signal is a negative voltage signal, the reference voltage VREF is set as a negative voltage, and the transistor T1 is an N-type transistor. The arrangement of the current protection circuit 230 is the same as the arrangement thereof in the first example. Therefore, the voltage V2 of the first control signal U2 is also calculated by the Equation (1), and the first control signal U2 is negatively correlated with the first voltage signal U1.

Since the reference voltage VREF is a constant value, in the case that the following formula (3) is satisfied, the voltage V2 of the first control signal U2 is a negative voltage, the transistor T1 is turned off, and the signal coupling circuit 240 outputs to the power driver IC 300 the pulse signal CTRL' from the signal generation circuit 220.

$$V1 > \frac{(Rg + Rf) \times VREF}{Rf} \tag{3}$$

With the decreasing of the voltage V1 of the first voltage signal U1, when the formula (3) is not satisfied, the voltage V2 of the first control signal U2 becomes a positive voltage, and the amplitude |V2| of the voltage V2 of the first control signal U2 is positively correlated with the amplitude |V1| of the voltage V1 of the first voltage signal U1. When the amplitude |V2| of the voltage V2 of the first control signal U2 is less than the amplitude |Vth| (i.e., |V2|<|Vth|) of the threshold voltage Vth of the transistor T1, the transistor T1 remains off, and the signal coupling circuit 240 continues outputting to the power driver IC 300 the pulse signal CTRL' from the signal generation circuit 220. The power driver IC 300 can dynamically adjust the voltage of the EL drive signal ELVDD/ELVSS outputted by the power driver IC 300, according to the parameter, such as the frequency, the period, the amplitude, and the duty cycle, of the pulse signal CTRL'. For example, the EL drive voltage is properly reduced if the frequency of the pulse signal CTRL' is higher than a preset value. The EL drive voltage is properly increased if the frequency of the pulse signal CTRL' is lower than the preset value.

With further decreasing of the voltage V1 of the first voltage signal U1, when the voltage V1 of the first voltage signal U1 is overhigh so that the amplitude |V2| of the voltage V2 of the first control signal U2 is greater than or equal to the amplitude |Vth| of the threshold voltage Vth of the transistor T1 (i.e., |V2|≥|Vth|), the transistor T1 is turned on, and the voltage of the second electrode of the transistor T1 is equal to that of the first electrode of the transistor T1 (i.e., a low level). In such a case, the signal coupling circuit 240 outputs a low level signal to the power driver IC 300, and the power driver IC 300 is automatically restarted, so that the voltage of the EL drive signal ELVDD/ELVSS outputted by the power driver IC 300 is reset.

In a third example, when the detected EL drive signal is a positive voltage signal, the reference voltage VREF is set as a positive voltage, and the transistor T1 is an N-type transistor. The difference between the arrangement of the current protection circuit 230 in this example and that of the current protection circuit 230 in the first example is that the first end of the first resistor Rg is coupled to the reference voltage VREF, and the first end of the third resistor Rb is coupled to the output terminal (i.e., the first voltage signal U1) of the current sensing circuit.

According to the above arrangement, the voltage V2 of the first control signal U2 is calculated by the following Equation:

$$V2 = \frac{(Rg + Rf) \times V1 - Rf \times VREF}{Rg} \tag{4}$$

As can be seen from the above Equation (4), the first control signal U2 is positively correlated with the first voltage signal U1. Since the reference voltage VREF is a constant value, in the case that the following formula (5) is satisfied, the voltage V2 of the first control signal U2 is a negative voltage, the transistor T1 is turned off, and the signal coupling circuit 240 outputs to the power driver IC 300 the pulse signal CTRL' from the signal generation circuit 220.

$$V1 < \frac{Rf \times VREF}{(Rg + Rf)} \tag{5}$$

With the increasing of the voltage V1 of the first voltage signal U1, when the formula (5) is not satisfied, the voltage V2 of the first control signal U2 becomes a positive voltage. When the amplitude |V2| of the voltage V2 of the first control signal U2 is lower than the amplitude |Vth| of the threshold voltage Vth of the transistor T1 (i.e., |V2|<|Vth|), the transistor T1 remains off, and the signal coupling circuit 240 continues outputting to the power driver IC 300 the pulse signal CTRL' from the signal generation circuit 220. The power driver IC 300 can dynamically adjust the voltage of the EL drive signal ELVDD/ELVSS outputted by the power driver IC 300, according to the parameter, such as the frequency, the period, the amplitude, and the duty cycle, of the pulse signal CTRL'. For example, the EL drive voltage is properly reduced if the frequency of the pulse signal CTRL' is higher than a preset value. The EL drive voltage is properly increased if the frequency of the pulse signal CTRL' is lower than the preset value.

With further increasing of the voltage V1 of the first voltage signal U1, when the voltage V1 of the first voltage signal U1 is overhigh so that the amplitude |V2| of the voltage V2 of the first control signal U2 is greater than or equal to the amplitude |Vth| of the threshold voltage Vth of the transistor T1 (i.e., |V2|≥|Vth|), the transistor T1 is turned on, and the voltage of the second electrode of the transistor T1 is equal to that of the first electrode of the transistor T1 (i.e., a low level). In such a case, the signal coupling circuit 240 outputs a low level signal to the power driver IC 300, and the power driver IC 300 is automatically restarted, so that the voltage of the EL drive signal ELVDD/ELVSS outputted by the power driver IC 300 is reset.

In a fourth example, when the detected EL drive signal is a negative voltage signal, the reference voltage VREF is set as a negative voltage, and the transistor T1 is a P-type transistor. The arrangements of each element in the current protection circuit 230 and the input signals are the same as those of each element and the input signals in the third example. Therefore, the voltage V2 of the first control signal U2 is also calculated by the Equation (4), and the first control signal U2 is positively correlated with the first voltage signal U1.

Since the reference voltage VREF is a constant value, in the case that the following formula (6) is satisfied, the voltage V2 of the first control signal U2 is a positive voltage, the transistor T1 is turned off, and the signal coupling circuit 240 outputs to the power driver IC 300 the pulse signal CTRL' from the signal generation circuit 220.

$$V1 > \frac{Rf \times VREF}{(Rg + Rf)} \tag{6}$$

With the decreasing of the first voltage V1, i.e. with the increasing of the amplitude |V1| of the first voltage V1, when the formula (6) is not satisfied, the voltage V2 of the first control signal U2 becomes a negative voltage. When the amplitude |V2| of the voltage V2 of the first control signal U2 is lower than the amplitude |Vth| of the threshold voltage Vth of the transistor T1 (i.e., |V2|<|Vth|), the transistor T1 remains off, and the signal coupling circuit 240 continues outputting to the power driver IC 300 the pulse signal CTRL' from the signal generation circuit 220. The power driver IC 300 can dynamically adjust the voltage of the EL drive signal ELVDD/ELVSS outputted by the power driver IC 300, according to the parameter, such as the frequency, the period, the amplitude, and the duty cycle, of the pulse signal CTRL'. For example, the EL drive voltage is properly reduced if the frequency of the pulse signal CTRL' is higher than a preset value. The EL drive voltage is properly increased if the frequency of the pulse signal CTRL' is lower than the preset value.

With further decreasing of the first voltage V1, when the amplitude |V2| of the voltage V2 of the first control signal U2 is greater than or equal to the amplitude |Vth| of the threshold voltage Vth of the transistor T1 (i.e., |V2|≥|Vth|), the transistor T1 is turned on, and the voltage of the second electrode of the transistor T1 is equal to that of the first electrode of the transistor T1 (i.e., a low level). In such a case, the signal coupling circuit 240 outputs a low level signal to the power driver IC 300, and the power driver IC 300 is automatically restarted, so that the voltage of the EL drive signal ELVDD/ELVSS outputted by the power driver IC 300 is reset.

Figure 4:
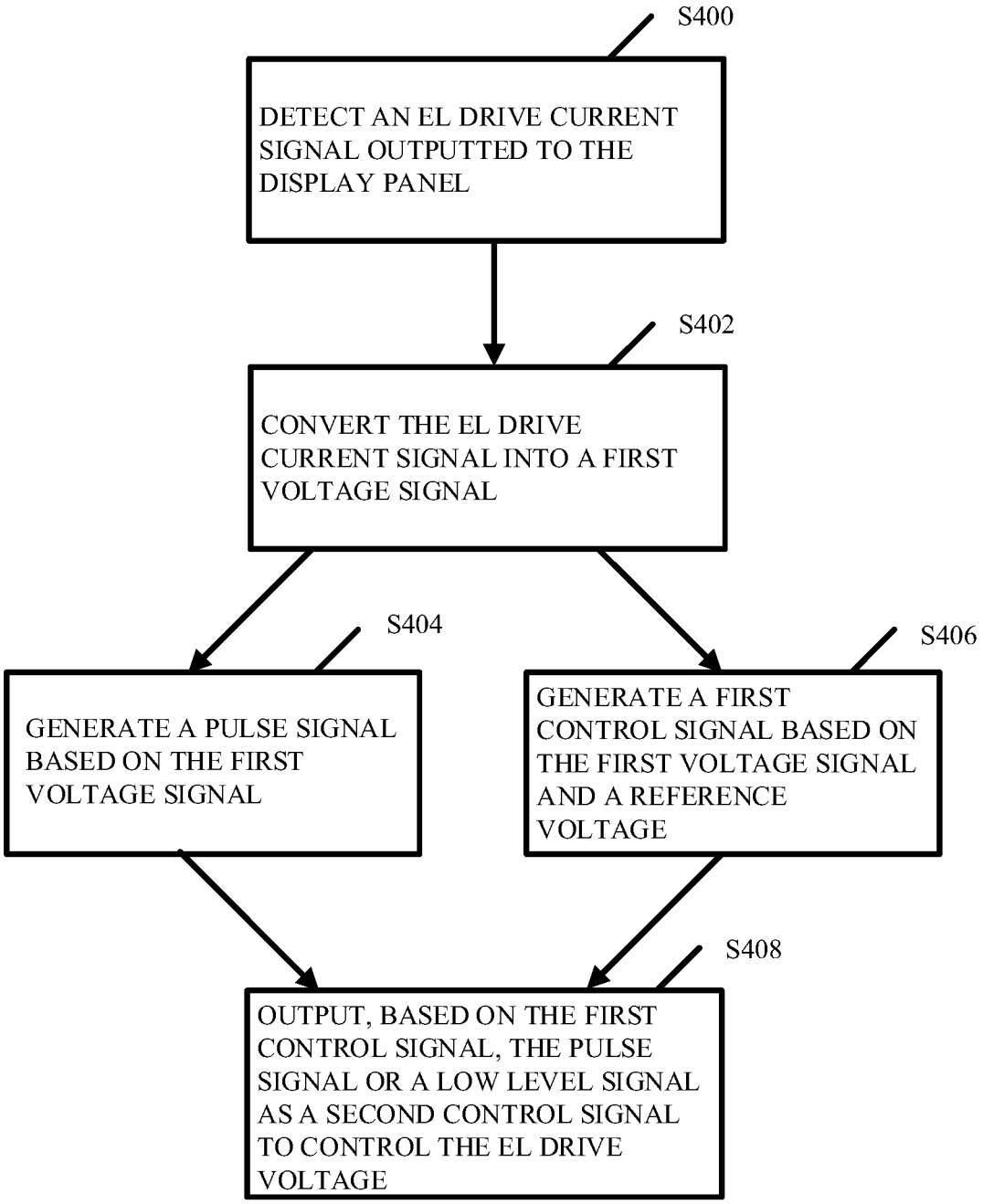
FIG. 4 is a schematic flowchart of a method for controlling an EL drive voltage for a display panel according to an embodiment of the present disclosure.

FIG. 4 illustrates a schematic flowchart of a method for controlling an EL drive voltage for a display panel according to an embodiment of the present disclosure. The method for controlling an EL drive voltage for a display panel is described below with reference to FIG. 4.

At S400, an EL drive current signal outputted to the display panel 100 is detected.

At S402, the EL drive current signal is converted into the first voltage signal U1.

At S404, the pulse signal CTRL' is generated based on the first voltage signal U1.

At S406, the first control signal U2 is generated based on the first voltage signal U1 and the reference voltage VREF.

At S408, the pulse signal CTRL' or the low level signal is outputted as a second control signal CTRL based on the first control signal U2 to control the EL drive voltage.

In the above steps, the execution sequence of S408 and S406 may be exchanged or may be parallel.

In an example of this embodiment, the amplitude of the first voltage signal U1 is positively correlated with that of the EL drive current signal. That is, the greater the amplitude of the first voltage signal U1 is, the greater the amplitude of the EL drive current signal is. When the amplitude of the first voltage signal U1 is positively correlated with that of the EL drive current signal, the sign of the first voltage signal U1 may be the same as or opposite to that of the EL drive current signal.

In an example of this embodiment, the parameter, such as the frequency, the period, the amplitude, and the duty cycle, of the pulse signal CTRL' is set based on the amplitude of the first voltage signal U1.

In an example of this embodiment, the first control signal U2 is linearly correlated with the first voltage signal U1.

In an example of this embodiment, at s408, when the amplitude of the first control signal U1 is lower than a threshold, the second control signal U2 is the pulse signal CTRL'; and when the amplitude of the first control signal U1 is greater than or equal to the threshold, the second control signal U2 is a low level signal.

In an example of this embodiment, at S408, in the case that the pulse signal CTRL' is used as the second control signal U2, the EL drive voltage is adjusted according to the parameter of the pulse signal CTRL'. The EL drive voltage is reset in the case that the low level signal is used as the second control signal U2.

In conclusion, the apparatus and method, and the display apparatus for controlling an EL drive voltage for a display panel according to the embodiments of the present disclosure can detect the current of the EL drive signal ELVDD/ELVSS, and realize a dynamic voltage control of the EL drive signal ELVDD/ELVSS through the detected current. Therefore, the dynamic voltage control method may realize a dynamic control of power consumption of the display panel. When the power consumption of the display panel exceeds a predetermined power consumption, the power driver IC is automatically restarted to reset the voltage of the EL drive signal ELVDD/ELVSS, thereby ensuring the power consumption of the display panel returns to normal.

The display apparatus provided by the embodiment of the present disclosure may be any product having a display function, such as an electronic paper display, a mobile phone, a tablet computer, a TV set, a notebook computer, a digital photo frame, a navigation apparatus, and so on.

As used herein and in the appended claims, the singular form of a word includes the plural, and vice versa, unless the context clearly dictates otherwise. Thus, singular words are generally inclusive of the plurals of the respective terms. Similarly, the words "include" and "comprise" are to be interpreted as inclusively rather than exclusively. Likewise, the terms "include" and "or" should be construed to be inclusive, unless such an interpretation is clearly prohibited from the context. Where used herein the term "examples," particularly when followed by a listing of terms is merely exemplary and illustrative, and should not be deemed to be exclusive or comprehensive.

Further adaptive aspects and scopes become apparent from the description provided herein. It should be understood that various aspects of the present disclosure may be implemented separately or in combination with one or more other aspects. It should also be understood that the description and specific embodiments in the present disclosure are intended to describe rather than limit the scope of the present disclosure.

A plurality of embodiments of the present disclosure has been described in detail above. However, apparently those skilled in the art may make various modifications and variations on the embodiments of the present disclosure without departing from the spirit and scope of the present disclosure. The scope of protecting of the present disclosure is limited by the appended claims.

What is claimed is:

1. An apparatus for generating an EL drive voltage control signal for a display panel, the apparatus comprising:

a current sensing circuit configured to detect an EL drive current signal outputted to the display panel, and convert the EL drive current signal into a first voltage signal;

a signal generation circuit directly connected to the current sensing circuit, and configured to generate a pulse signal based on the first voltage signal from the current sensing circuit;

a current protection circuit directly connected to the current sensing circuit, and configured to generate a first control signal based on the first voltage signal from the current sensing circuit and a reference voltage; and a signal coupling circuit directly connected to the signal generation circuit and the current protection circuit, the signal coupling circuit including a transistor configured to receive the first control signal from the current protection circuit and the pulse signal from the signal generation circuit, and output, based on the received first control signal, the pulse signal as the EL drive voltage control signal or a low level signal as the EL drive voltage control signal.

2. The apparatus according to claim 1, wherein an amplitude of the first voltage signal is positively correlated with that of the EL drive current signal.

3. The apparatus according to claim 2, wherein the signal generation circuit is further configured to set a parameter of the pulse signal based on the amplitude of the first voltage signal, and wherein the parameter of the pulse signal includes one or more of a frequency, a period, an amplitude, and a duty cycle.

4. The apparatus according to claim 2, wherein the signal generation circuit includes a signal generator based on 1-wire protocol.

5. The apparatus according to claim 1, wherein the signal generation circuit is further configured to set a parameter of the pulse signal based on an amplitude of the first voltage signal, and wherein the parameter of the pulse signal includes one or more of a frequency, a period, an amplitude, and a duty cycle.

6. The apparatus according to claim 1, wherein the signal generation circuit includes a signal generator based on 1-wire protocol.

7. The apparatus according to claim 1, wherein the first control signal is linearly correlated with the first voltage signal.

8. The apparatus according to claim 1, wherein the current protection circuit includes a first resistor, a second resistor, a third resistor, a first capacitor, and an operational amplifier, wherein a first end of the first resistor is coupled to one of an output terminal of the current sensing circuit and a reference voltage terminal, a second end of the first resistor is coupled to a first end of the second resistor, a first end of the first capacitor, and an inverting input terminal of the operational amplifier;

wherein a second end of the second resistor is coupled to a second end of the first capacitor and an output terminal of the operational amplifier, and the output terminal of the operational amplifier is an output terminal of the current protection circuit; and wherein a first end of the third resistor is coupled to the other one of the output terminal of the current sensing circuit and the reference voltage terminal, and a second end of the third resistor is coupled to a non-inverting input terminal of the operational amplifier.

9. The apparatus according to claim 8, wherein the signal coupling circuit is configured to output the pulse signal in response to an amplitude of the first control signal being less than a threshold, and output the low level signal in response to the amplitude of the first control signal being greater than or equal to the threshold.

10. The apparatus according to claim 9, wherein the signal generation circuit includes an output terminal, wherein the transistor of the signal coupling circuit includes a control electrode coupled to the output terminal of the current protection circuit, a first electrode coupled to a low level signal terminal, and a second electrode coupled to the output terminal of the signal generation circuit, and wherein the second electrode is used as an output terminal of the signal coupling circuit.

11. The apparatus according to claim 8, wherein the signal generation circuit includes an output terminal, wherein the transistor of the signal coupling circuit includes a control electrode coupled to the output terminal of the current protection circuit, a first electrode coupled to a low level signal terminal, and a second electrode coupled to the output terminal of the signal generation circuit, and wherein the second electrode is used as an output terminal of the signal coupling circuit.

12. The apparatus according to claim 1, wherein the signal coupling circuit is configured to output the pulse signal in response to an amplitude of the first control signal being less than a threshold, and output the low level signal in response to the amplitude of the first control signal being greater than or equal to the threshold.

13. The apparatus according to claim 1, wherein the current protection circuit includes an output terminal, wherein the signal generation circuit includes an output terminal, wherein the transistor of the signal coupling circuit includes a control electrode coupled to the output terminal of the current protection circuit, a first electrode coupled to a low level signal terminal, and a second electrode coupled to the output terminal of the signal generation circuit, and wherein the second electrode is used as an output terminal of the signal coupling circuit.

14. A display apparatus comprising:

a display panel; and the apparatus according to claim 1, the apparatus configured to generate the EL drive voltage control signal to control an EL drive voltage outputted to the display panel.

15. A method for generating an EL drive voltage control signal for a display panel using the apparatus according to claim 1, the method comprising:

detecting an EL drive current signal outputted to the display panel;

converting the EL drive current signal into a first voltage signal;

generating a pulse signal based on the first voltage signal;

generating a first control signal based on the first voltage signal and a reference voltage; and outputting, based on the first control signal, the pulse signal as the EL drive voltage control signal or a low level signal as the EL drive voltage control signal.

16. The method according to claim 15, wherein an amplitude of the first voltage signal is positively correlated with that of the EL drive current signal.

17. The method according to claim 15, wherein generating the pulse signal based on the first voltage signal includes setting a parameter of the pulse signal based on an amplitude of the first voltage signal, the parameter of the pulse signal including one or more of a frequency, a period, an amplitude, and a duty cycle.

18. The method according to claim 15, wherein the first control signal is linearly correlated with the first voltage signal.

19. The method according to claim 15, wherein outputting, based on the first control signal, the pulse signal as the EL drive voltage control signal or a low level signal as the EL drive voltage control signal comprises:

outputting the pulse signal as the EL drive voltage control signal in response to an amplitude of the first control signal being less than a threshold, and outputting the low level signal as the EL drive voltage control signal in response to the amplitude of the first control signal being greater than or equal to the threshold.

20. The method according to claim 15, wherein an EL drive voltage is configured to adjust according to a parameter of the pulse signal when the pulse signal is output as the EL drive voltage control signal, or reset when the low level signal is output as the EL drive voltage control signal.

* * * * *